US009868620B1

(12) United States Patent
Flippin

(10) Patent No.: US 9,868,620 B1
(45) Date of Patent: Jan. 16, 2018

(54) EXPANDABLE CAR JACK

(71) Applicant: James Alford Flippin, Davie, FL (US)

(72) Inventor: James Alford Flippin, Davie, FL (US)

( * ) Notice: Subject to any disclaimer, the term of this patent is extended or adjusted under 35 U.S.C. 154(b) by 0 days.

(21) Appl. No.: 15/189,322

(22) Filed: Jun. 22, 2016

(51) Int. Cl.
*B66F 3/22* (2006.01)
*B66F 13/00* (2006.01)
*B66F 3/12* (2006.01)

(52) U.S. Cl.
CPC ..... *B66F 3/22* (2013.01); *B66F 3/12* (2013.01); *B66F 13/00* (2013.01)

(58) Field of Classification Search
CPC ..... B66F 3/00; B66F 3/08; B66F 3/38; B66F 3/12; B66F 13/00; B66F 7/00; A47G 33/12
See application file for complete search history.

(56) References Cited

U.S. PATENT DOCUMENTS 1,887,924 A 11/1932 Evans
1,982,642 A * 12/1934 Curok ..... B66F 3/22 254/1
2,189,687 A * 2/1940 Thomas ..... A47G 33/12 248/523
2,493,978 A * 1/1950 Kromer ..... B66F 13/00 211/203
2,572,205 A * 10/1951 Shanks ..... A47B 3/00 211/132.1
2,580,743 A 1/1952 Eckels
2,616,650 A * 11/1952 Thompson ..... B66F 13/00 248/346.3
1,903,341 A 4/1953 Mitchell
3,117,764 A * 1/1964 Schultz ..... B66F 3/38 254/134
3,831,959 A * 8/1974 Fontana ..... B62B 5/0083 248/907
3,920,212 A 11/1975 Westwood
3,923,318 A * 12/1975 Renard ..... A45C 13/385 280/35
3,970,278 A * 7/1976 Studer ..... B66F 13/00 248/165
4,245,808 A * 1/1981 John ..... B66F 3/08 248/165
4,712,758 A * 12/1987 Cuschera ..... A47B 13/023 248/188.7
4,743,039 A * 5/1988 Ellis ..... B62B 3/10 248/188.4

(Continued)

*Primary Examiner* — Monica Carter
*Assistant Examiner* — Seahee Yoon
(74) *Attorney, Agent, or Firm* — The Concept Law Group, P.A.; Scott D. Smiley

(57) ABSTRACT

An expandable car jack including a base with a first base extension member and a second extension member rotatably, removably, and directly coupled to one another, the first and second base extension members operably configured to rotate with respect to one another to define a planar lower support surface forming an x-shape or a substantially perpendicular configuration. The expandable car jack may also include a plurality of hinged members supported by the base, wherein the plurality of hinged members define a lifting surface and are coupled together with a screw, the screw operably configured to rotate, expand and contract a width separating the plurality of hinged members, and place the lifting surface at a plurality of raised height positions.

14 Claims, 8 Drawing Sheets

(56) References Cited

U.S. PATENT DOCUMENTS

| | | | | |
|---|---|---|---|---|
| 5,915,672 | A | 6/1999 | Dicket | |
| 6,234,451 | B1 * | 5/2001 | Baron | B66F 3/08 254/122 |
| 6,581,908 | B1 * | 6/2003 | Francis | B25H 1/0007 254/134 |
| 6,644,615 | B1 | 11/2003 | Liu | |
| 6,964,423 | B1 * | 11/2005 | Chieh | B62B 5/0083 248/129 |
| 7,644,896 | B1 * | 1/2010 | Niner | B25B 11/002 248/121 |
| 8,109,476 | B2 * | 2/2012 | Roberts | B65B 67/1205 248/100 |
| 8,398,056 | B1 | 3/2013 | Morrison | |
| 8,684,372 | B2 * | 4/2014 | Buttazzoni | B62B 5/0083 280/35 |
| 9,103,493 | B2 | 8/2015 | Klinzmann | |
| 2004/0173996 | A1 * | 9/2004 | Anderson | B62B 5/0083 280/651 |
| 2005/0017223 | A1 * | 1/2005 | Lucas | B66F 13/00 254/1 |
| 2005/0211862 | A1 * | 9/2005 | Autenrieth | E02F 9/085 248/431 |
| 2016/0340164 | A1 * | 11/2016 | Koteski | B66F 13/00 |

* cited by examiner

100

EXPANDABLE CAR JACK

FIELD OF THE INVENTION

The present invention relates generally to vehicle jacks, and, more particularly, relates to bases used in junction with car jacks.

BACKGROUND OF THE INVENTION

Mechanical devices used to lift heavy loads (commonly referred to as "jacks") are well known and used for a variety of different applications, including vehicle maintenance and repairing or changing tires, among other things. These jacks may utilize screw threads, hydraulics, or other mechanisms to generate a lifting force. Most jacks utilized for vehicles, such as cars, have a maximum lifting capacity in the range of 1.5 to 3 tons, but that capacity may be more or less depending on the jack's intended application. A common jack employed by many vehicle manufacturers is the "scissor" jack, or a jack utilizing threading or "jackscrew" that causes lifting arms to pivot and raise or lower a lifting surface on the scissor jack depending on the rotation of the jackscrew. The scissor jack has been used for a decades and is desirous for many vehicle manufacturers because it is generally reliable, generally maintenance free, and relatively compact when placed in a collapsed (non-lifting) position.

One significant problem with vehicle jacks, particularly scissor jacks, is the lack of stability when placed in a raised (lifting) position. This lack of stability generates an unsafe environment for users of the jacks, leading to many injuries and even fatalities over the years. The lack of stability and increased chance for user injury is exacerbated when the vehicle jack is utilized in combination with an unstable or uneven ground surface upon which the jack rests. Over the years, there have been some advances to increase stability and reduce injuries. These advances, however, have their own associated disadvantages.

One well-known method and device utilized to increase stability includes the use of one or more "jack stands." These jack stands are employed in connection with a vehicle jack and are often used as an independent means to support the weight of the vehicle after the vehicle has been raised. As implied, the jack stands do nothing to increase the stability of the jack during the lifting or lowering process. Moreover, because of the size and cost of most jack stands, most vehicle manufacturers do not incorporate or utilize jack stands on the vehicle. As such, users desirous of utilizing jack stands have to expend the time and money to purchase one. Additionally, even if the jack stands are utilized, they often do not facilitate the creation of a more stable support surface because of the shape of the legs of the jack stands.

Another known method and device utilized to increase the stability of a car jack during the lifting and lowering process includes the jack utilizing a telescoping base. One such example includes the "jack track" embodied in U.S. Pat. No. 1,887,924, issued Nov. 15, 1932. These telescoping bases are problematic in that they only extend in one directional axis, which would be insufficient to generate a stable surface for the jack positioned over an uneven surface in two or more directions. These telescoping bases also utilize numerous inter-working components that require additional manufacturing and installation time and costs, thereby increasing the overall retail price. The telescoping bases are also more prone to overall failure should one of the numerous telescoping components break or fail, which is more likely for these telescoping or extending bases considering the volatile joints, links, and components utilized therein. Many of these telescoping bases also increase the overall size of the jack, thereby leaving the desired compactness of the jack unfulfilled. Some known jacks also utilize foldable bases, but these too suffer from many of the above-mentioned disadvantages, including the use of multiple components prone to failure and increased costs and the increased size of the jack when in a collapsed state.

Therefore, a need exists to overcome the problems with the prior art as discussed above.

SUMMARY OF THE INVENTION

The invention provides an expandable car jack base that overcomes the hereinafore mentioned disadvantages of the heretofore-known devices and methods of this general type and that Although the invention is illustrated and described herein as embodied in an expandable car jack base, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

With the foregoing and other objects in view, there is provided, in accordance with the invention, an expandable car jack that includes a portable base and vehicle lifting assembly coupled to one another, wherein the vehicle lifting assembly has a lifting surface and is operably configured to place the lifting surface at a plurality of raised height positions with respect to a lower support surface, opposing the lifting surface, of the base. The base includes a first base extension member having a lower surface, a proximal end, a distal end, and a first member length separating the proximal and distal ends of the first base extension member, a second base extension member coupled to the first base extension member and also has a lower surface, a proximal end, a distal end, and a second member length separating the proximal and distal ends of the second base extension member. The base also includes a first position along a base expansion path with the first and second base extension members in an overlapping and substantially parallel configuration with one another and with the lower surface of the second base extension member, spanning the second member length, defining the lower support surface, and a second position along the base expansion path with the first and second base extension members in overlapping and substantially perpendicular configurations with one another and with the lower surface of the second base extension member, spanning the second member length, and the lower surface of the first base extension member together defining the lower support surface.

In accordance with a further feature of the present invention, the lower support surface is planar.

In accordance with another feature, an embodiment of the present invention includes a fastener and a spring, wherein the first and second base extension members are removably, directly, and biasedly coupled together with the fastener and the spring.

In accordance with an additional feature of the present invention, the first and second base extension members are interposed between the spring and head and retaining portions of the fastener.

In accordance with yet another feature, an embodiment of the present invention also includes the first base extension member and/or the second base extension member having a recess centrally disposed and defined thereon, wherein the recess has another of the first base extension member and/or second base extension member disposed therein when the base is in the second position along the base expansion path. The recesses may be defined by walls of the first and/or second base extension members and may restrict rotational or lateral movement of the base extension member disposed therein.

In accordance with a further feature, an embodiment of the present invention also includes each of the first and second base extension members having a complementary recess disposed and defined thereon, wherein each of the complementary recesses has another one of the first and/or second base extension members disposed therein when the base is in the second position along the base expansion path.

In accordance with another feature, an embodiment of the present invention includes a plurality of ridges disposed within the complementary recess of one of the first and/or second base extension members; and a plurality of inset groves defined by another of the first and/or second base extension members and disposed within the complementary recess of the another of the first and second base extension members, each of the plurality of inset grooves spanning into respective shoulders restricting lateral (and/or rotational) movement of a respective one of the plurality of ridges disposed within a respective one of the plurality of inset grooves when the base is in the second position along the base expansion path.

In accordance with a further feature of the present invention, the plurality of ridges and the plurality of inset grooves are arcuate and the shoulders of the plurality of inset grooves are centrally disposed at opposing ends of the complementary recess of the another of the first and second base extension members.

In accordance with yet another feature of the present invention, the plurality of ridges and the plurality of inset grooves are symmetrical with respect to each other when the first and second base extension members are in the first position along the base expansion path.

In accordance with another feature, an embodiment of the present invention includes a fastener coupling the first and second base extension members together and, when in the second position along the base expansion path, defining four support segments each having equal lengths separating a distal end the respective four support segments and the fastener.

In accordance with the present invention, an expandable car jack is also disclosed that includes a base with a first base extension member and a second extension member rotatably, removably, and directly coupled to one another, the first and second base extension members operably configured to rotate with respect to one another to define a planar lower support surface forming an x-shape, and includes a plurality of hinged members supported by the base, defining a lifting surface, and coupled together with a screw, the screw operably configured to rotate, expand and contract a width separating the plurality of hinged members, and place the lifting surface at a plurality of raised height positions.

In accordance with the present invention, an expandable car jack is also disclosed that includes a base with a first base extension member and a second extension member rotatably, removably, biasedly, and directly coupled to one another with a fastener and a spring, the first and second base extension members operably configured to rotate with respect to one another about the fastener along a base expansion path to reach a locked position forming an x-shape, and a plurality of hinged members supported by the base, defining a lifting surface, and coupled together with a screw, wherein the screw operably configured to rotate, expand and contract a width separating the plurality of hinged members, and place the lifting surface at a plurality of raised height positions.

In accordance with a further feature of the present invention, the second extension member also includes a planar lower support surface, wherein the locked position includes the first and second base extension members defines the planar lower support surface.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the jack spanning from a first end to a second end when the jack is in a collapsed position.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
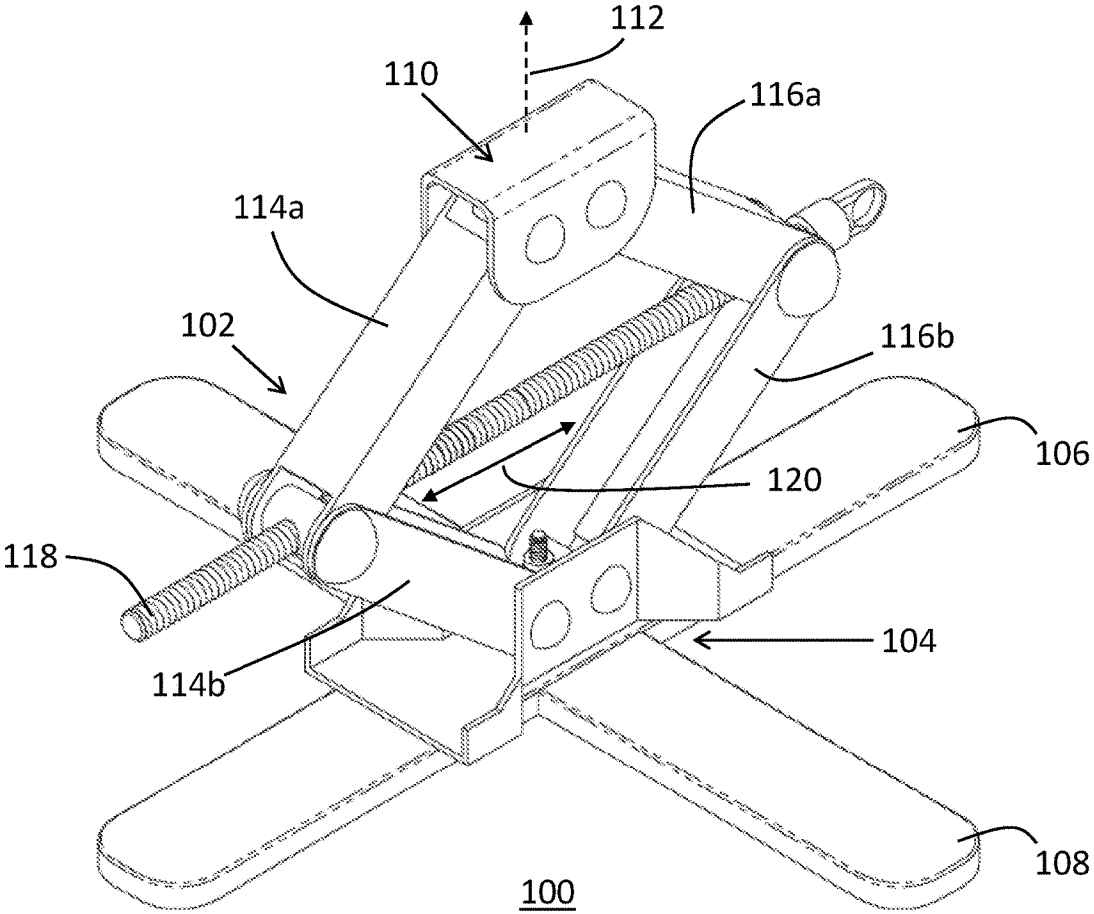
FIG. 1 is a perspective downward-looking view of an expandable car jack with the base and lifting assembly in extended and raised positions, respectively, in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient expandable car jack that is collapsible for convenient storage and is advantageously operable to expand to increase the overall supporting surface area for the jack when lifting vehicles such as cars. The car jack is also designed to effectively and quickly increase the overall supporting surface area with use of minimal components, thereby reducing overall manufacturing and assembly costs.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of an expandable car jack 100 as shown in FIG. 1, includes a vehicle lifting assembly 102 coupled to an expandable base 104. Both the lifting assembly 102 and the base 104 may be portable, or capable of hand-held transportation by a user. The base 104 can be seen having two base extension members, also referred to as a first base extension member 106 and a second base extension member 108. The first and second base extension members 106, 108 are rotatably coupled to one another and operably configured to beneficially increase the supporting area of the jack for more stability when the vehicle is raised or lowered. While the first base extension member 106 is depicted as the top extension member, in certain embodiments, the first extension member 106 may be the bottom extension member, and vice versa with respect to the second extension member 108. The increase in supporting area for the jack 100 reduces the likelihood of the jack 100 buckling or succumbing to a moment force caused by a supported vehicle that would cause the jack 100 to tilt or collapse, especially when utilized in connection with an uneven ground surface.

Figure 7:
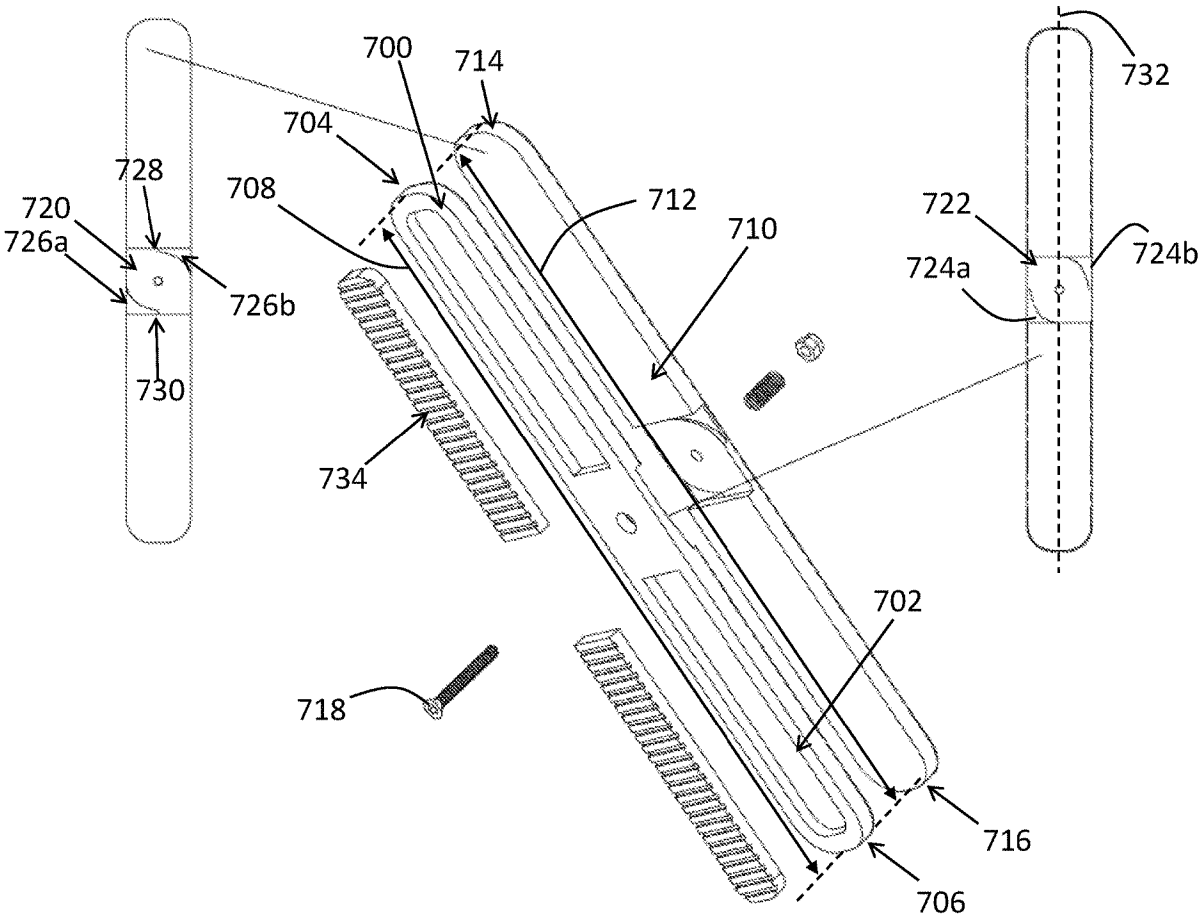
FIG. 7 is an exploded view of the car jack base of FIG. 1 removed from the lifting assembly.

With reference to FIGS. 1 and 7, the vehicle lifting assembly 102 has a lifting surface 110 and is operably configured to place the lifting surface 110 at a plurality of raised height positions with respect to a lower support surface 700 of the base 104. A representative path in which the lifting surface 110 may translate, to generate the plurality of raised height positions, is depicted with arrow 112. As will be appreciated by those of the skill in the art, the lifting assembly 102 may include a plurality of hinged members 114*a-b*, 116*a-b*, supported by the base 104, that are coupled together with a screw 118. The screw 118 is operably configured to rotate, expand and contract a width (represented with arrow 120) separating the plurality of hinged members 114*a-b*, 116*a-b*.

While the expandable base 104 is particularly beneficial when employed with a scissor jack, so that a compact, reliable, and safe lifting mechanism can be utilized with many cars, trucks, or other vehicles, the lifting assembly 102 is not necessarily limited to scissor jacks. As such, the inventive base 104 can be utilized with hydraulic lifts or other pneumatic lifting assemblies to generate the lifting force necessary to raise a vehicle. The lower support surface 700 can be seen opposing the lifting surface 110. The lifting surface 110 and the lower support surface 700 may be entirely planar. To promote a stable and reliable supporting surface for the jack 100, the lower support surface 700 is planar, i.e., entirely planar, having two or more surfaces defining a plane that is substantially parallel to the lifting surface 110, or predominantly and/or substantially planar.

Figure 2:
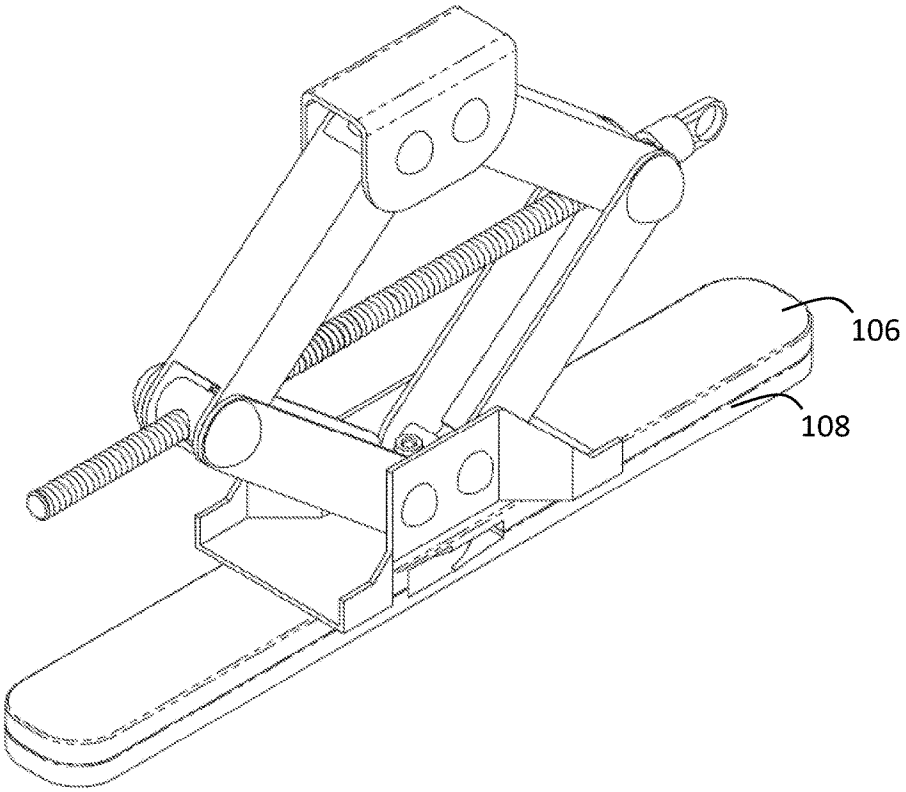
FIG. 2 is a perspective downward-looking view of the base and lifting assembly of FIG. 1 when the base is in a retracted position.
Figure 3:
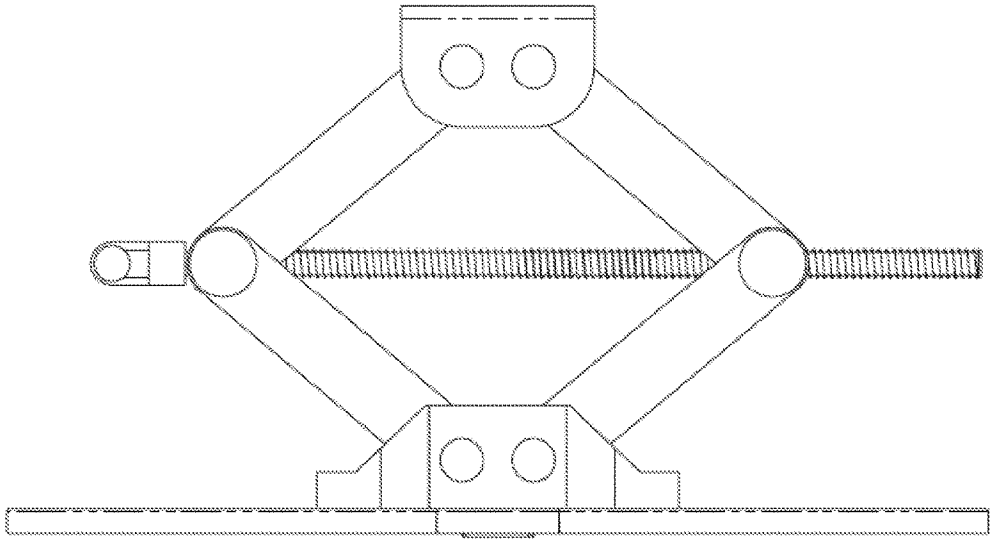
FIG. 3 is an elevational side view of the base and lifting assembly of FIG. 1.
Figure 4:
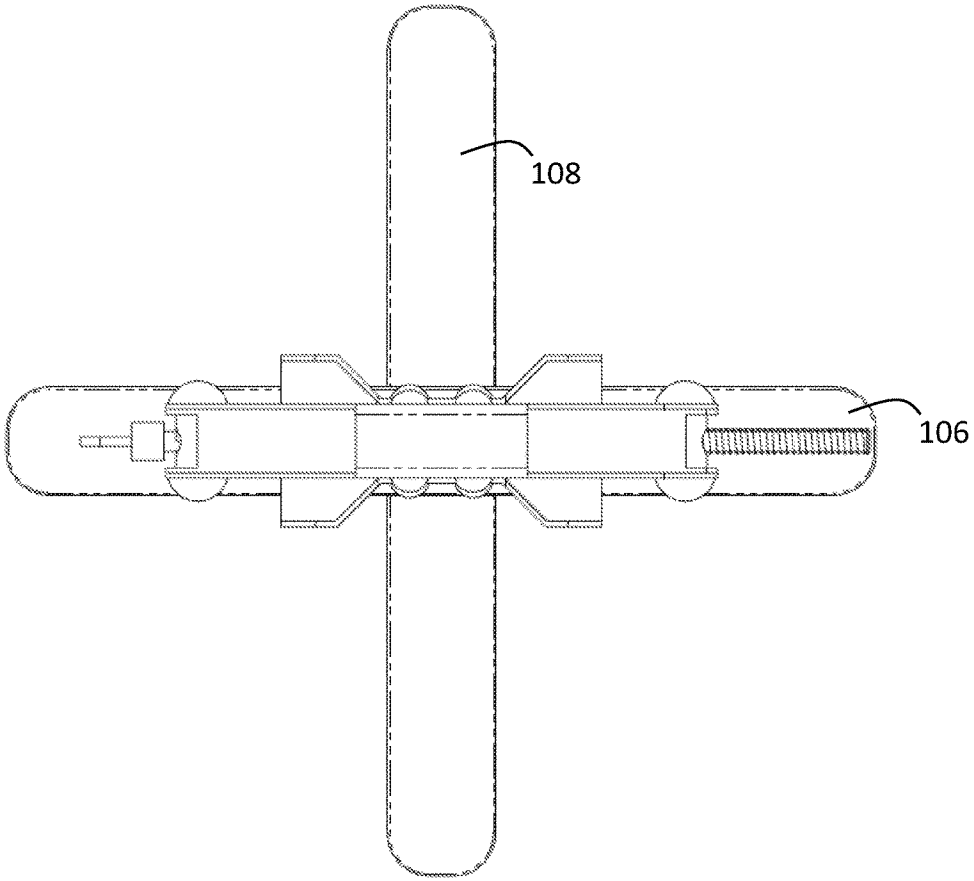
FIG. 4 is a top plan view of the base and lifting assembly of FIG. 1.
Figure 5:
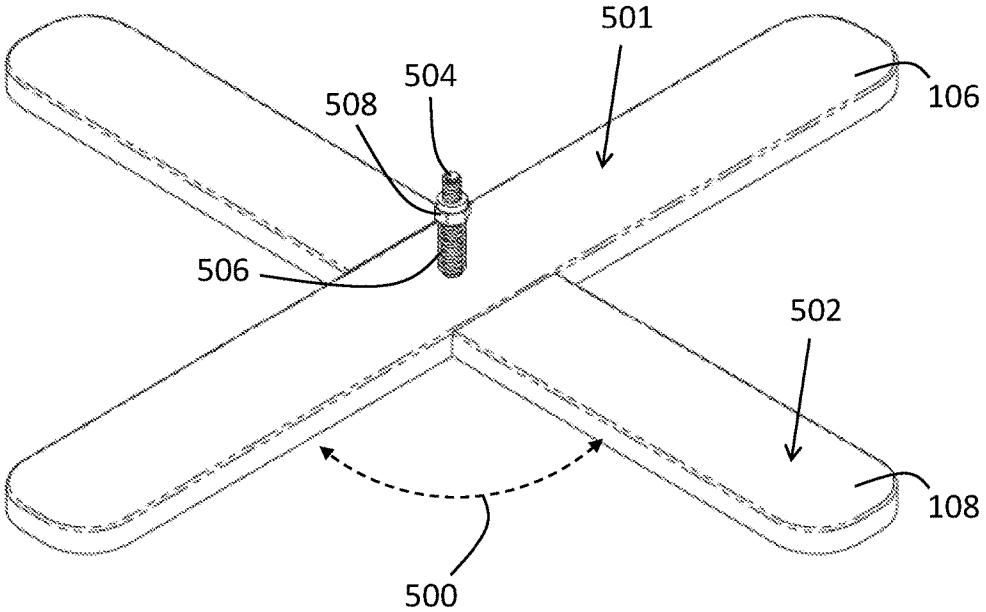
FIG. 5 is a fragmentary view of the car jack base of FIG. 1 removed from the lifting assembly.
Figure 6:
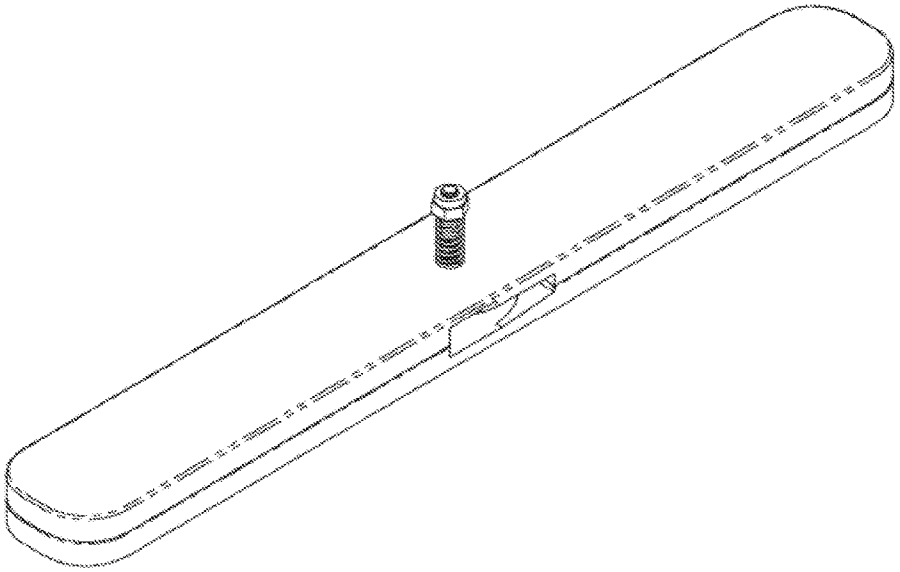
FIG. 6 is a fragmentary view of the car jack base of FIG. 1 removed from the lifting assembly and in the retracted position.

With reference to FIGS. 2 and 6, the first and second base extension members 106, 108 can be seen depicted in a first position along a base expansion path. The first position along the base expansion path may also be referred to as a stowed position. With reference to FIGS. 1 and 3-5, the first and second base extension members 106, 108 can be seen depicted in a second position along the base expansion path. The second position along the base expansion path may also be referred to as a deployed position. An exemplary base expansion path can be seen represented in FIG. 5 with arrow 500. The base expansion path 500 may be circular or of another shape, and may rotate clock-wise or counter clockwise. The first position includes the first and second base extension members 106, 108 in an overlapping and substantially parallel configurations with one another.

With reference now to FIGS. 1, 2, and 7, a lower surface 702 of the second base extension member 108 spans a second member length (represented by arrow 708) separating proximal and distal ends 704, 706 of the member 108, wherein, in the first position, the lower surface 702 defines the lower support surface 700. Said another way, the lower surface 702 of the second member 108 is the surface in which provides the supporting surface for the jack 100 while lifting a vehicle. When in the second position, with the first and second base extension members 106, 108 in overlapping and substantially perpendicular (90°+/−10°) configurations with one another to advantageously increase the supporting surface area of the jack 100. As seen in the figures, the members 106, 108 do not necessarily need to completely overlap to be considered overlapping. As seen in FIG. 1, the members 106, 108 are in a substantially perpendicular configuration and partially overlapping. When in the second position, the base extension members 106, 108 can also be seen forming an x-shape, as depicted best in FIG. 4. The x-shape is not necessarily limited to two segments (i.e., the first and second base extension members 106, 108) disposed at substantially perpendicular configurations, but rather it is two segments intersecting with one another along a length of said segments that is not the distal end of said segments.

When in the second position, however, a lower surface 702 of the second base extension member 108, spanning along the second member length 708 as shown in FIG. 7, and a lower surface 710 of the first base extension member 106 together define the lower support surface 700. The lower surface 710 of the first base extension member 106 can be seen also spanning a length (represented by arrow 712) separating proximal and distal ends 714, 716 of the first base extension member 106. As a portion of the lower surface 712 intersects with the second member 108, the entire surface 712 will not form the entire supporting surface 700. As seen in the figures, the first and second base extension members 106, 108 may be plate-like, or relatively flat and thin. The first and second base extension members 106, 108 may be of a metallic material such as steel, aluminum, or other metal. In other embodiments, the base extension members 106, 108 may be of a substantially rigid polymeric or ceramic material sufficient to support the average weight of a vehicle, or approximately 1.5-2 tons. Of course the material may be designed to support more weight than 1.5-2 tons. In one embodiment, the lengths 708, 712 may be substantially equal (within +/−approximately 1-2 inches) and the first and second base extension members 106, 108 share perimeter edges. In other embodiments, the lengths 708, 712 may be unequal and the edges of the members 106, 108 may not correspond to one another. The width and thickness of the base extension members 106, 108 may be approximately 2-5 inches and 0.25-0.75 inches, respectively. However, dimensions outside of said ranges may vary.

With reference now to FIGS. 5-6, each of the lower surfaces 702, 710 of the respective members 106, 108 may oppose respective upper surfaces 501, 502 of the members 106, 108. Each of the members 106, 108 may include a bore or aperture there-through, wherein the bore has a fastener 504 disposed therein. A spring 506 may also be utilized in connection with the fastener 504 to removably, directly, and biasedly couple the first and second base extension members 106, 108 together when in the first position and/or the second position along the base expansion path 500. Said another way, the base extension members 106, 108 are biased to be compressed with one another, but may be decompressed (or removed from a directly coupled configuration) by applying a tension force on each member 106, 108 to separate the members 106, 108 from one another.

The first and second base extension members 106, 108 may also be interposed between the spring 506 and a head portion 718 (shown in FIG. 7) and a retaining portion 508 of the fastener 504. The retaining portion 508 of the fastener 504 may be a nut, a lynch pin, a hitch pin, or other mechanism capable of retaining the spring 506. The head portion 718 may be recessed within the bottom or lower surface 702 and does not necessarily require a flange, as the spring 506 may be supported by or rest on the upper surface 501 of the first base extension member 102. The spring 506 may be a compression spring having a spring constant ranging from approximately 5-10 lb/in, or may vary outside of said range. The spring 506 beneficially may have one end disposed adjacent to the upper surface 501 of the first base extension member 106, wherein the free end of the spring 506 may be disposed and concealed by the lifting assembly 102 when coupled to the base 104.

With reference now to FIGS. 5-7, one or both of the first and second base extension members 106, 108 may define a recess centrally disposed and defined thereon. The recess serves as a channel or a volume in which a corresponding member may rest or lie. As specifically shown in FIG. 7, both base extension members 106, 108 define complementary recesses 720, 722, or recesses shaped and sized to receive one another (as best depicted in FIG. 5). Each recess 720, 722 has another of the first and/or second base extension members 106, 108 disposed therein when the base 104 is in the second position along the base expansion path 510. To maintain structural integrity of the members 106, 108 while minimizing the overall thickness of the base 104, each of the members 106, 108 includes recesses 720, 722. However, only one recess may be formed on one of the members in other embodiments. The one or more recess(es) 720, 722 may be centrally disposed, or at a mean position along the length(s) 708, 712. The recess(es) 720, 722 may also be centrally disposed, in that said recess(es) 720, 722 may be disposed at the center of mass of the one or more member(s) 106, 108.

One or more of the recess(es) 720, 722 may include one or a plurality of ridges 724*a-b* disposed within one of the recess(es) 720, 722 of one of the first or second base extension members 106, 108, while a plurality of inset groves 726*a-b* are defined by another of the first or second base extension members 106, 108. Said inset grooves 726*a-b* may also be disposed within the complementary recess of another of either the first or second base extension members 106, 108. As seen in FIG. 7, each of the plurality of inset grooves inset grooves 726*a-b* span into one or more shoulders 728, 730, or a structure acting as barrier that restricts lateral or traverse movement of one of the ridges 724*a-b* disposed therein when in the second position. In one embodiment, the plurality of ridges 724*a-b* and the plurality of inset grooves 726*a-b* are arcuate so to effectuate an easier and quick entry and egress of the ridges 724*a-n* into said grooves 726*a-b*.

As the second base extension member 108 defines the lower supporting surface 700 in both the first and second positions along the base expansion path 500, a gripping surface 734 may be utilized and consist of one or more rubber ridges. As will be appreciated, the gripping surface 734 may be of another anti-slip or friction-increasing material or coating. Like the second base extension member 108, the first base extension member 106 may also have a gripping surface. As seen in FIG. 7, the gripping surface 724 may also form the lower support surface 700.

Still referring to FIGS. 5-7, the one or more shoulders 728, 730 of the plurality of inset grooves 726*a-b* are centrally disposed at opposing ends of the complementary recess of the another of the first and second base extension members 106, 108. The opposing ends are the longitudinal ends of the recess 722 and the shoulders 728, 730 can be seen centrally disposed at said ends, or at a mid-point of the recess 722. The recesses 720, 722 may be a thickness from an upper or lower surface, respectively, of approximately 0.5-0.75 inches, while the inset grooves 726*a-b* may be approximately 0.1-0.25 inches. Dimensions outside of those ranges may also be possible or desired based on the design constraints or intended applications. To ensure alignment and sufficient lateral or traverse resistance when the second member 108 is placed in the second position, the plurality of ridges 724*a-b* and the plurality of inset grooves 724*a-b* may be symmetrical when the first and second base extension members are in the first position along the base expansion path 500. Said another way, the ridge 724*b* has a shape that is symmetrical to a shape of the grove 726*b* about a line 732, often the center or mid-point line, of the second member 108. The ridge 724*b* may also be considered to be inversely symmetrical with respect to the ridge 724*a* about the line 732. Similar to the ridges 724*a-b*, the inset groves 726*a-b* may also be considered inversely symmetrical with respect to each other.

Figure 8:
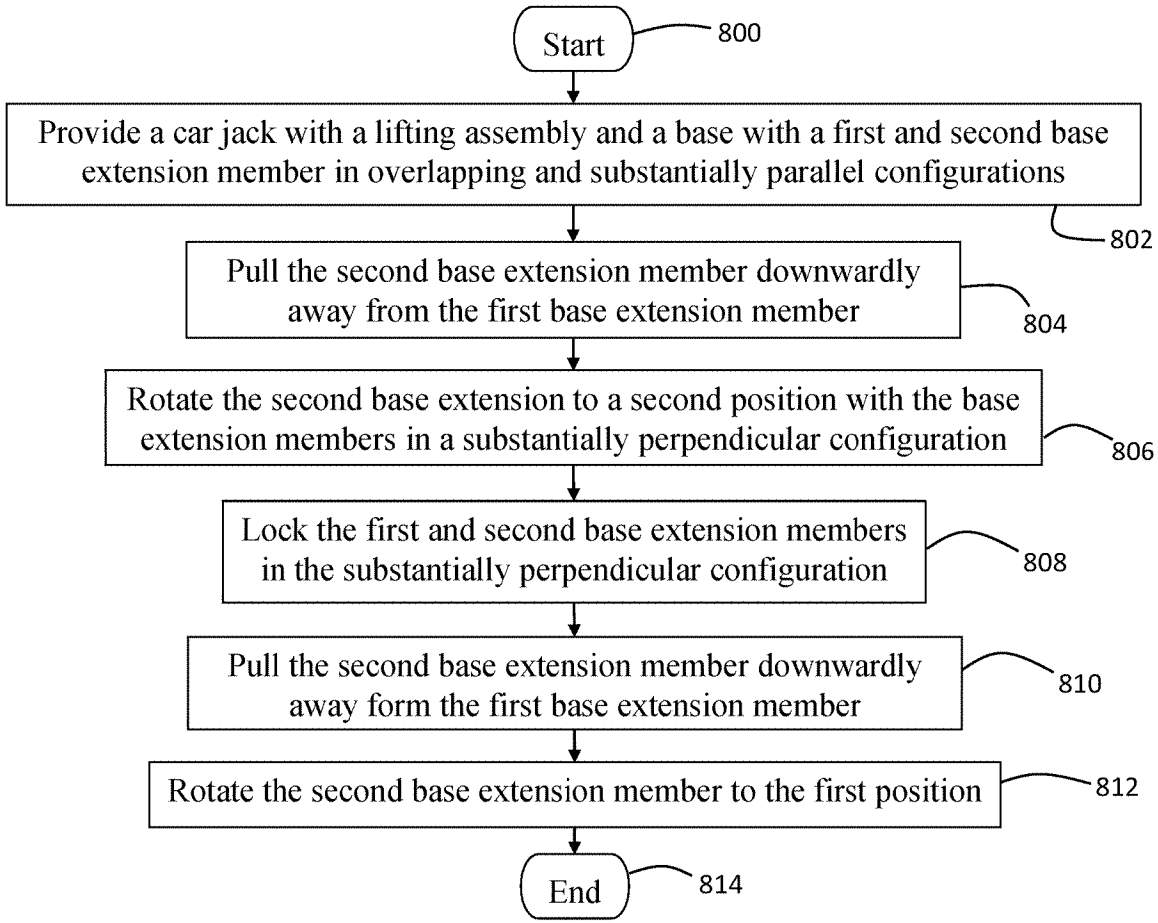
FIG. 8 is a process flow diagram depicting a method of lifting a vehicle with an extendable jack in accordance with one embodiment of the present invention.

FIGS. 1, 2, and 7 will be described in conjunction with the process flow chart of FIG. 8. Although FIG. 8 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 8 for the sake of brevity. In some embodiments, some or all of the process steps included in FIG. 8 can be combined into a single process. A process of expanding the base of car jack starts at step 800 and immediately proceeds to step 802 of providing a car jack with a lifting assembly and two base extension members, as described above. The base, or more particularly the two base extension members of the base, is in the first or stowed position. The process continues to step 804 of initiating a base expansion path by pulling the second base extension member downwardly away from first base extension member, as the two extension members may be locked together when in the first position along a base expansion path. They may be locked, for example, with a fastener or a tongue-and-grove configuration. Alternatively, because the extension members may be biasedly compressed together, the extension members may have notches and ridges disposed thereon and sized and shape to receive one another so as to restrict rotational movement of the extension members.

Next, the process may continue to step 806 of rotating the second base extension member so as to form an x-shape or substantially perpendicular configuration with respect to the first base extension member. Now, a car jack can advantageously increase its overall supporting surface area and reduce the likelihood of buckling, tilting, or collapsing. Next, the process may proceed to step 808 of locking the first and second base extension members. They may be locked as described above, or through recesses, offset ridges, inset grooves, or other mechanisms. To place the first or stowed position When it is desired to place the base back in the first or stowed position, a user may proceed to step 810 of pulling the second base extension member downwardly away from first base extension member, as the two extension members may be locked together by, for example, one or more shoulders or walls defining the one or more recesses in which the base extension member is therein disposed. Step 812 would be to rotate (counterclockwise or clockwise) the second base extension member so that it is placed back into the first or stowed position. The process terminates in step 814.

An expandable car jack has been disclosed that car jack base that is advantageously collapsible for convenient storage and operable to expand to increase the overall supporting surface area for the jack when lifting or lowering vehicles, such as cars. The car jack is also designed to effectively and quickly increase the overall supporting surface area with use of minimal components, thereby reducing overall manufacturing and assembly costs, along with the possibility of the expandable car jack failing when exposed to significant weight.

What is claimed is:

1. An expandable car jack comprising:

a portable base and a vehicle lifting assembly coupled to one another, the vehicle lifting assembly having a lifting surface and operably configured, through at least one of a threaded screw-hinge configuration and pneumatic force, to place the lifting surface at a plurality of raised height positions with respect to a lower support surface, opposing the lifting surface, of the base, the base including:

a first base extension member having a planar lower surface, a proximal end, a distal end, and a first member length separating the proximal and distal ends of the first base extension member;

a second base extension member coupled to the first base extension member and having a planar lower surface, a proximal end, a distal end, and a second member length separating the proximal and distal ends of the second base extension member;

a first position along a base expansion path with the first and second base extension members in a vertically-stacked overlapping and substantially parallel configuration with one another where the planar lower surface of the first base extension member and the planar lower surface of the second base extension member are non-coplanar with one another; and a second position along the base expansion path with the first and second base extension members in overlapping and substantially perpendicular configurations with one another where the planar lower surface of the first base extension member and the planar lower surface of the second base extension member are coplanar with one another.

2. The expandable car jack according to claim 1, further comprising:

a fastener and a spring, wherein the first and second base extension members are removably, directly, and biasedly coupled together with the fastener and the spring.

3. The expandable car jack according to claim 2, wherein:

the first and second base extension members are interposed between the spring and head and retaining portions of the fastener.

4. The expandable car jack according to claim 1, wherein at least one of the first base extension member and second base extension member further comprises:

a recess centrally disposed and defined thereon, wherein the recess has another of the at least one of the first base extension member and second base extension member disposed therein when the base is in the second position along the base expansion path.

5. The expandable car jack according to claim 1, wherein each of the first and second base extension members further comprise:

a complementary recess disposed and defined thereon, wherein each of the complementary recesses has another of the at least one of the first and second base extension members disposed therein when the base is in the second position along the base expansion path.

6. The expandable car jack according to claim 5, further comprising:

a plurality of ridges disposed within the complementary recess of one of the first and second base extension members; and a plurality of inset grooves defined by another of the first and second base extension members and disposed within the complementary recess of the another of the first and second base extension members, each of the plurality of inset grooves spanning into respective shoulders restricting lateral movement of a respective one of the plurality of ridges disposed within a respective one of the plurality of inset grooves when the base is in the second position along the base expansion path.

7. The expandable car jack according to claim 6, wherein:

the plurality of ridges and the plurality of inset grooves are arcuate.

8. The expandable car jack according to claim 6, wherein:

the shoulders of the plurality of inset grooves are centrally disposed at opposing ends of the complementary recess of the another of the first and second base extension members.

9. The expandable car jack according to claim 6, wherein:

the plurality of ridges and the plurality of inset grooves are symmetrical with respect to each other when the first and second base extension members are in the first position along the base expansion path.

10. The expandable car jack according to claim 1, further comprising:

a fastener coupling the first and second base extension members together and, when in the second position along the base expansion path, defining four support segments each having equal lengths separating a distal end the respective four support segments and the fastener.

11. An expandable car jack comprising:

a base with a first base extension member and a second extension member rotatably, removably, and directly coupled to one another, each of the first and second base extension members:

having a planar lower surface; and operably configured to rotate with respect to one another from a vertically-stacked overlapping and substantially parallel configuration with one another where the planar lower surface of the first base extension member and the planar lower surface of the second base extension member are non-coplanar with one another, to an overlapping and substantially perpendicular configuration with one another where the planar surface of the first base extension member and the planar surface of the second base extension member are coplanar with one another, forming an x-shape; and a plurality of hinged members supported by the base, defining a lifting surface, and coupled together with a screw, the screw operably configured to rotate, expand and contract a width separating the plurality of hinged members, and place the lifting surface at a plurality of raised height positions.

12. The expandable car jack according to claim 11, further comprising:

a spring and a fastener, wherein the first and second base extension members are biasedly coupled together with the fastener and the spring.

13. An expandable car jack base comprising:

a base with a first base extension member and a second base extension member rotatably, removably, biasedly, and directly coupled to one another with a fastener and a spring, at least one of the first base extension member and the second base extension member having side walls defining a recess thereon and the first and second base extension members operably configured to rotate with respect to one another about the fastener along a base expansion path to reach a locked position, forming an x-shape, with the other of the at least one of the first base extension member and the second base extension member disposed within the recess and restricted from rotational movement by at least one of the side walls of the at least one of the first base extension member and the second base extension member, each of the first and second base extension members having a planar lower surface; and a plurality of hinged members supported by the base, defining a lifting surface, and coupled together with a screw, the screw operably configured to rotate, expand and contract a width separating the plurality of hinged members, and place the lifting surface at a plurality of raised height positions, wherein the planar lower surface of the first base extension member and the planar lower surface of the second base extension member are coplanar with one another in the locked position.

14. The expandable car jack according to claim 13, wherein:

the locked position includes the first and second base extension members defining four support segments each having equal lengths separating a distal end the respective four support segments and the fastener.

* * * * *